US007367258B2

(12) United States Patent
Wanschura et al.

(10) Patent No.: US 7,367,258 B2
(45) Date of Patent: May 6, 2008

(54) LONGITUDINALLY ADJUSTABLE REVERSIBLE AXIAL PISTON MACHINE

(75) Inventors: Guenter Wanschura, Ulm (DE); Hakan Camurdan, Neu-Ulm (DE)

(73) Assignee: Brueninghaus Hydromatik GmbH, Elchingen (DE)

( * ) Notice: Subject to any disclaimer, the term of this patent is extended or adjusted under 35 U.S.C. 154(b) by 221 days.

(21) Appl. No.: 10/559,514

(22) PCT Filed: Mar. 29, 2004

(86) PCT No.: PCT/EP2004/003323

§ 371 (c)(1),
(2), (4) Date: Dec. 5, 2005

(87) PCT Pub. No.: WO2004/109060

PCT Pub. Date: Dec. 16, 2004

(65) Prior Publication Data

US 2006/0123984 A1 Jun. 15, 2006

(30) Foreign Application Priority Data

Jun. 6, 2003 (DE) ..... 103 25 842

(51) Int. Cl.
*F01B 13/04* (2006.01)
*F01B 31/14* (2006.01)

(52) U.S. Cl. ..... 92/12.2; 92/13.1; 91/506

(58) Field of Classification Search ..... 92/12.1, 92/12.2, 13, 13.1, 131; 91/506
See application file for complete search history.

(56) References Cited

U.S. PATENT DOCUMENTS

| | | | | |
|---|---|---|---|---|
| 4,896,585 | A * | 1/1990 | Forster | 92/12.2 |
| 5,226,349 | A | 7/1993 | Alme et al. | |
| 2002/0014149 | A1 | 2/2002 | Fiebing et al. | |

FOREIGN PATENT DOCUMENTS

| | | |
|---|---|---|
| DE | 40 492 | 10/1965 |
| DE | 33 46 000 A1 | 6/1984 |
| DE | 37 14 888 A1 | 11/1988 |
| DE | 39 35 800 A1 | 5/1991 |
| EP | 0 922 858 A2 | 6/1999 |

* cited by examiner

*Primary Examiner*—Michael Leslie
(74) *Attorney, Agent, or Firm*—Scully, Scott, Murphy & Presser, P.C.

(57) ABSTRACT

The invention relates to a reversible axial piston machine (1) consisting of a cylinder drum (5) which rotates about a rotational axis (7) and in which pistons can be displaced in cylinders (6), said pistons being supported against an inclined surface (8). The angle of adjustment (α1, α2) of the inclined surface (8) can be adjusted in both pivoting directions by means of a control piston (24) pertaining to the adjusting device (12), said control piston extending essentially parallel to the direction of the rotational axis (7) of the cylinder drum (5). The zero position of the adjustment of the inclined surface (8) can be adjusted without play by means of a zero position adjusting device (32).

17 Claims, 4 Drawing Sheets

LONGITUDINALLY ADJUSTABLE REVERSIBLE AXIAL PISTON MACHINE

Figure 1:
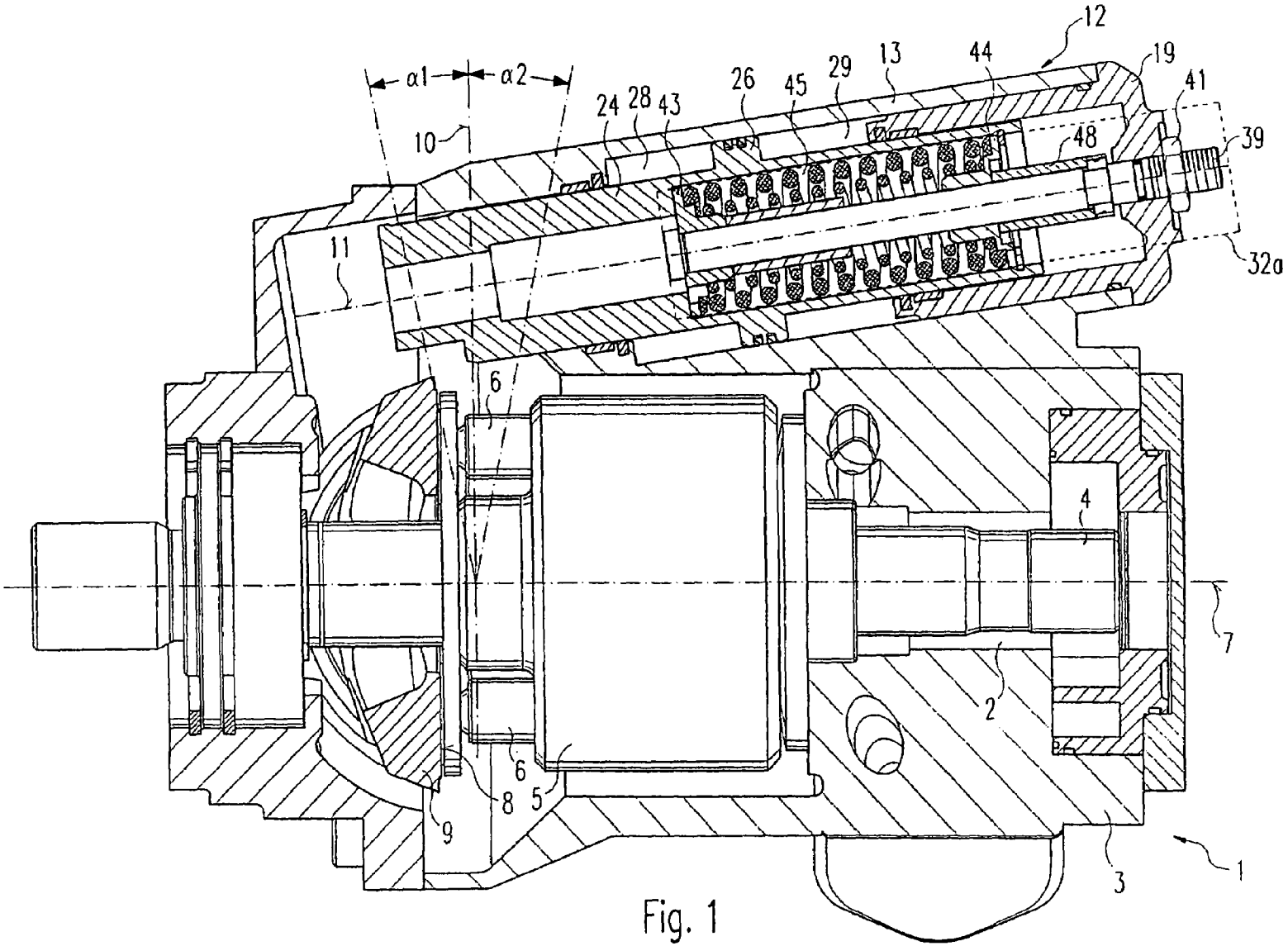

The invention relates to a reversible axial piston machine having an adjusting device for adjusting the pivot angle of a pivot balance of the reversible axial piston machine in both pivotal directions.

The volume of hydraulic fluid delivered in a rotation of the drive shaft of an axial piston machine is dependent on the stroke length of the cylinders arranged in a cylinder drum of an axial piston machine during a compression or suction procedure. The stroke length is set by inclined points of the inclined surface of a pivot balance, on which the individual cylinders are supported during their rotational movement about the drive axis, in relation to the axial alignment of the drive axis. The control angle of the inclined surface with respect to the axial alignment of the drive axis is adjusted by an adjusting device.

For axial piston machines which are operated in both pivotal directions—reversible axial piston machines—positive and negative adjustment angles have to be set at the pivot balances.

In principle, there are two embodiments for the arrangement of the adjusting device in relation to the arrangement of the drive axis of the axial piston machine. In the case of transverse adjustment, the adjusting device executes a translatory movement for adjusting the pivot balance transversely to the arrangement of the drive axis of the axial piston machine. In the case of longitudinal adjustment, the adjusting device executes a translatory movement for adjusting the pivot balance in the longitudinal direction of the drive axis of the axial piston machine. When taking into account structural considerations—for example when using the axial piston machine in mobile concrete mixers—longitudinal adjustment is preferred over transverse adjustment since this has a smaller overall volume.

A not insignificant problem with adjusting devices is the precise setting of the zero position. If, in the uncontrolled operating condition of the adjusting device, no control pressure is applied for example to a pressure-controlled adjusting device (unpressurised operating condition), the adjustment angle of the pivot balance is precisely zero degrees when the set zero position of the adjusting device is set correctly. In this case, the inclined surface is precisely perpendicular to the longitudinal axis of the drive shaft. None of the pistons in any of the cylinders of the cylinder drum is able to execute a stroke movement here.

DE 37 14 888 A1 illustrates a reversible axial piston machine having an adjusting device which operates according to the variant with longitudinal adjustment. The zero position of the pivot balance in the uncontrolled operation of the axial piston machine is non-adjustable and is undefined. In this axial piston machine, the adjustment angle which is actually set at the pivot balance does not, therefore, generally correspond precisely to the predetermined adjustment angle. The actual displacement volume therefore generally deviates from the predetermined displacement volume.

The object of the invention, therefore, is to further develop the reversible axial piston machine with longitudinal adjustment according to the features in the precharacterising clause of claim 1 in such a way that there is definitely no presence of displacement volume in the uncontrolled condition.

The object of the invention is achieved by a reversible axial piston machine having the features of claim 1.

According to the invention, to set the zero position in the pivot balance, a zero-position setting device is provided in the adjusting device according to claim 1. The advantage of this zero-position setting device is that the zero position of the inclined surface can be set precisely and without play in the uncontrolled operation of the axial piston machine.

Advantageous, and particularly detailed, constructions of the invention are described in the dependent claims.

A further advantage of the zero-position setting device can be seen in the use of a single pressure spring which is tensioned between two spring plates on the adjusting rod and acts on the control piston, which is displaceable in the adjusting device, in both control directions with the same pretension force. In the adjustment procedure for determining the zero position, it is thus possible to position the control piston, and the pivot balance which is coupled to the control piston by way of a form-fitting attachment, in both control or pivotal directions by means of a pretension force defined by the spring constant of the pressure spring. This means that there is no need to carry out a complex procedure for ensuring that the spring constants, and therefore the pretension forces, of two opposingly acting pressure springs, which in applications of this type normally each generate a pretension force for one adjusting device, are equally matched.

The claimed reversible axial piston machine and the associated adjusting device is furthermore advantageous in that the adjustment travel of the control piston or the adjustment angle of the pivot balance can be adjustably delimited by way of a second adjusting rod, which is likewise guided out of the adjusting device or the axial piston machine.

Finally, the claimed adjusting device is advantageous in that, owing to its hollow cylindrical construction, the control piston, the zero-position setting device and other components located within the hollow cylinder of the adjusting device can be assembled and dismantled in relatively simple manner.

Figure 2:
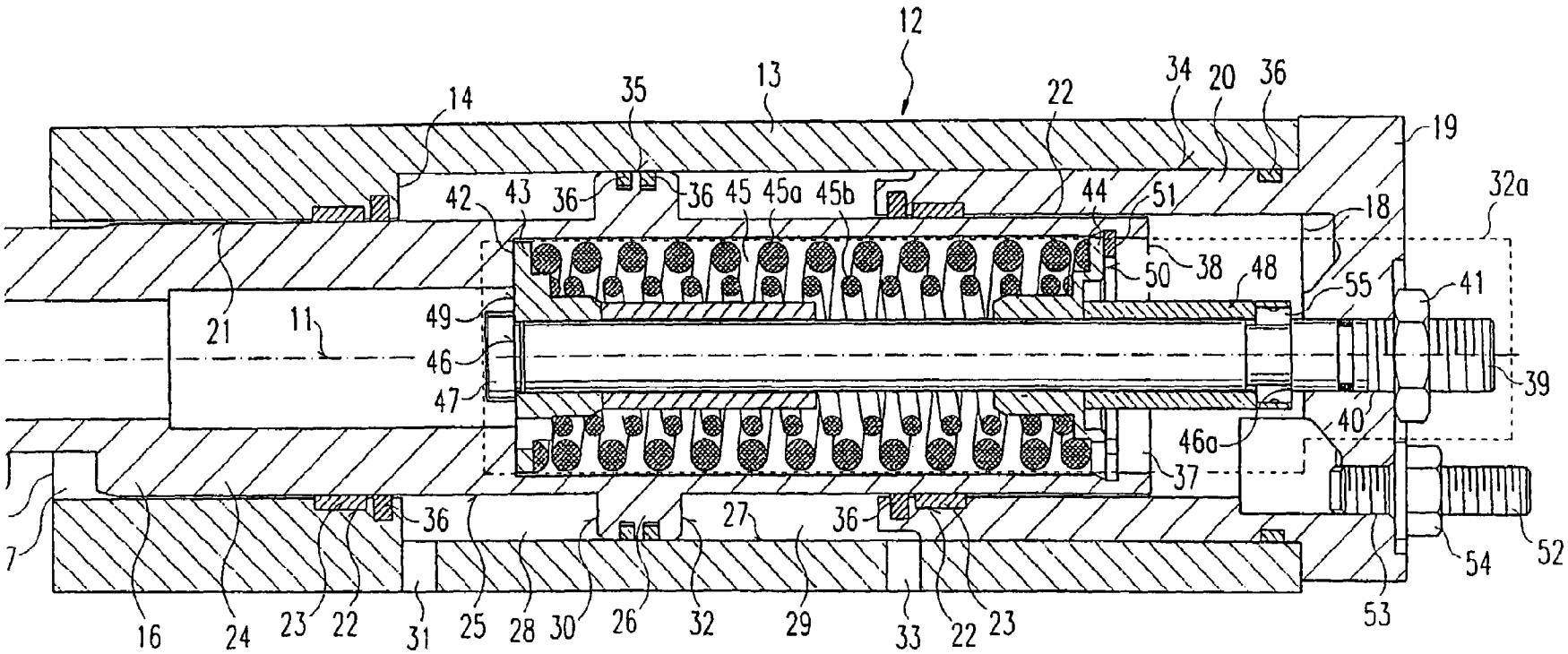
Figure 3:
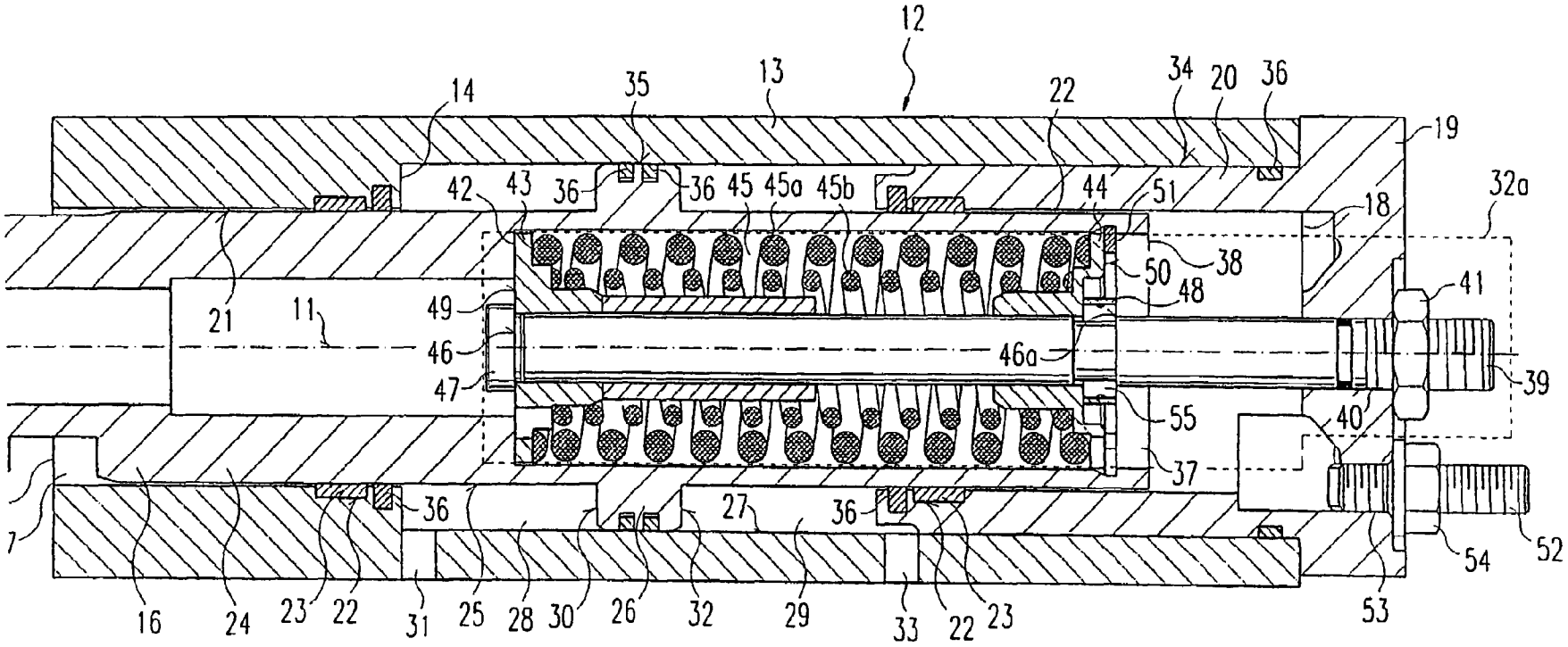
Figure 4:
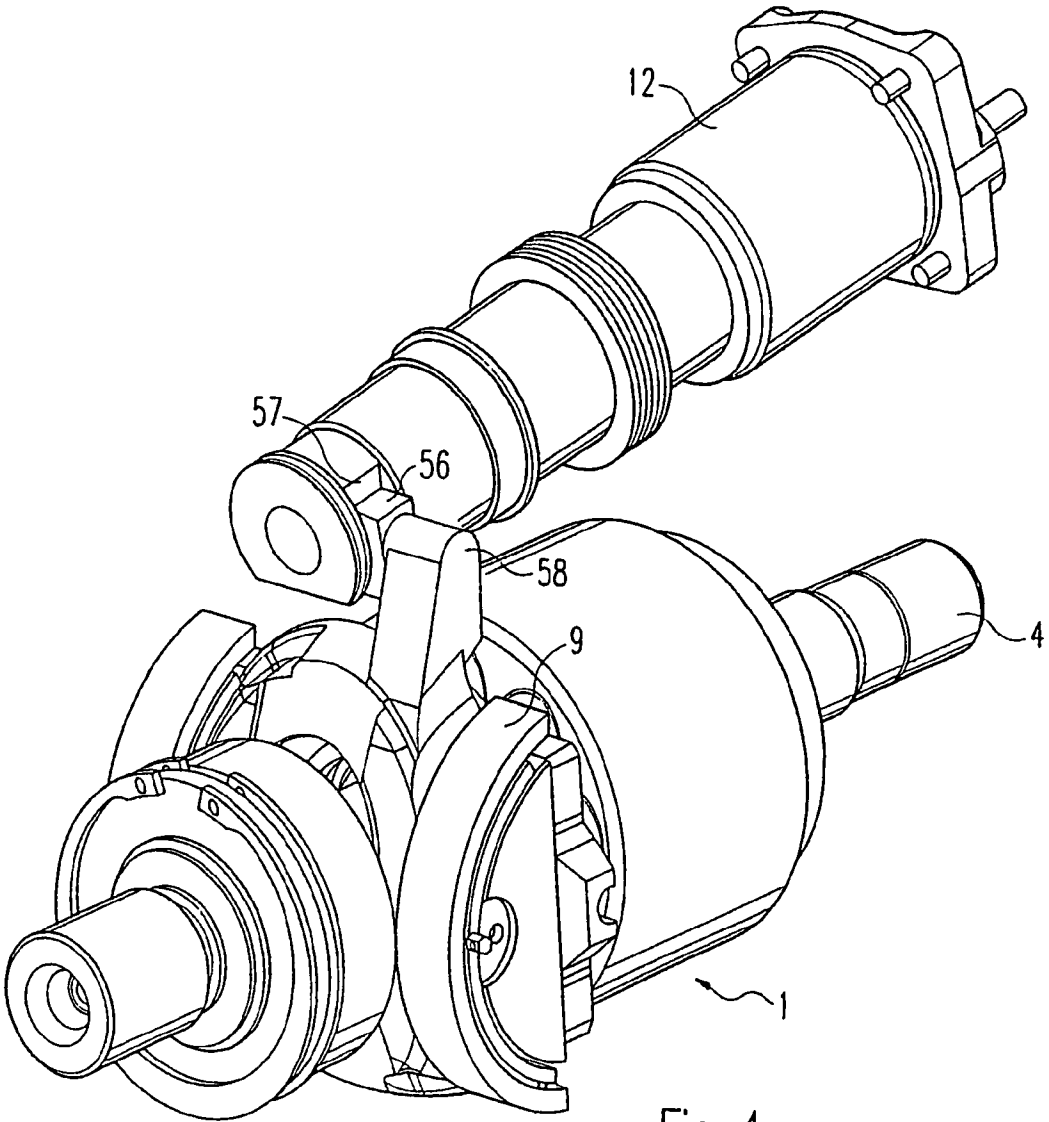

An exemplary embodiment of the invention is illustrated in the drawing and will be described in more detail below. The drawing shows:

FIG. 1 a cross-sectional illustration of an axial piston machine according to the invention, with an adjusting device according to the invention;

FIG. 2 a cross-sectional illustration of an adjusting device according to the invention;

FIG. 3 a cross-sectional illustration of a further embodiment of the adjusting device according to the invention; and FIG. 4 a three-dimensional view of an axial piston machine according to the invention, with an adjusting device according to the invention connected by way of a form-fitting attachment.

The reversible axial piston machine according to the invention and the adjusting device according to the invention are described in both their embodiments below with reference to FIG. 1 to FIG. 4.

FIG. 1 shows a cross-section of a reversible axial piston machine 1 according to the invention. This comprises a drive shaft 4 mounted in an axially aligned cutout 2 of the housing 3. Arranged in rotationally fixed manner on the drive shaft 4, there is a cylinder drum 5 in which a plurality of cylinder cutouts are arranged at equal mutual spacings from one another on a circle which is concentric with the longitudinal axis 7 of the drive shaft 4.

Displaceably guided in each of the cylinder cutouts, there is a piston 6 which has, on its end opposite the cylinder chamber, a spherical head which is pivotably mounted in a guide shoe and supported against an inclined surface 8.

In relation to a zero-position axis 10, which is aligned at a right angle to the axis of rotation 7 of the cylinder drum 5, the pivot balance 9, and with it the inclined surface 8, is pivotable through a positive adjustment angle $\alpha 1$ and negative adjustment angle $\alpha 2$ with respect to the zero-position axis 10.

The adjusting device 12, whereof the cross-section—in addition to the illustration in FIG. 1—is also illustrated on a slightly enlarged scale in FIG. 2, comprises a hollow cylinder 13 which serves as a housing and has a first step 14. The first opening 15 in the hollow cylinder 13, which faces the pivot balance 9, is not closed and enables a control piston 16 guided in the hollow cylinder 13 to be displaced at least partially out of the inner region 17 of the hollow cylinder 13. The second opening 18 of the hollow cylinder 13, which is opposite the first opening 15, is closed by a closing cover 19.

The closing cover 19 has an annular web 20. The external diameter of the annular web 20 of the closing cover 19 corresponds to the internal diameter of the hollow cylinder in the region between the first step 14 and the second opening 18. The internal diameter of the annular web 20 of the closing cover 19 corresponds to the internal diameter of the hollow cylinder 13 in the region between the first step 14 and the first opening 15. The closing cover 19 is guided into the interior 17 of the hollow cylinder 13 by means of an annular web 20 in such a way that a form-fitting connection is produced between the hollow cylinder 13 and the closing cover 19.

Incorporated in the inner lateral surface 21 of the hollow cylinder 13, between the first opening 15 and the first step 14, and also in the inner lateral surface 27 of the annular web 20 of the closing cover 19, there are annular grooves 22 in which guide rings 23, for example of brass, are arranged. These guide rings 23 serve as guide bearings for the control piston 24, which is mounted centrically to the longitudinal axis 11 in the interior 17 of the hollow cylinder 13 and is displaceable in the direction of the longitudinal axis 11.

The control piston 24 has a substantially hollow cylindrical geometry. At approximately half the cylinder height of the hollow cylindrical control piston 24, the control piston 24 has a flange-like widening 26 on its outer lateral surface 25. Since the width of this flange-like widening 26 corresponds to the width of the first step 14 of the hollow cylinder 13, the flange-like widening 26 of the control piston 24 is in contact with the inner lateral surface 27 of the hollow cylinder 13 between the first step 14 and the second opening 18.

The geometry of the control piston 24, the hollow cylinder 13 and the closing cover 19 in the region of the flange-like widening 26 of the control piston 24 results in the formation of a first control pressure chamber 28 and a second control pressure chamber 29 in the interior 17 of the hollow cylinder 13. The first side face 30 of the flange-like widening 26 of the control piston 24, which is connected to the first control pressure chamber 28, serves as a working surface for a control pressure which is guided through the first control pressure opening 31 in the wall of the hollow cylinder 13 and into the first control pressure chamber 28 for the purpose of displacing the control piston 24 along its longitudinal axis 11 in the direction of the second opening 18 of the hollow cylinder 13. The second side face 32 of the flange-like widening 26 of the control piston 24, which is connected to the second control pressure chamber 29, serves as a working surface for a control pressure which is guided through the second control pressure opening 33 in the wall of the hollow cylinder 13 and into the second control pressure chamber 29 for the purpose of displacing the control piston 24 along its longitudinal axis 32 in the direction of the first opening 15 of the hollow cylinder 13.

To seal the first and second control pressure chambers 28 and 29 against hydraulic fluid, sealing rings 36 which are guided in grooves are provided in the region of the inner lateral surfaces 21 and 27 of the hollow cylinder 13, the inner lateral surface 22 and the outer lateral surface 34 of the annular web 20 of the closing cover 19 and the end face 35 of the flange-like widening 26 of the control piston 24.

The hollow cylindrical control piston 24 has a multi-stepped cutout 37 whereof the largest third opening 38 faces in the direction of the second opening 18 of the hollow cylinder 13. A first adjusting rod 39 is guided along the longitudinal axis 11 of the control piston 24 into the multi-stepped cutout 37. This first adjusting rod 39 is guided out of the adjusting device 12 by way of a bore 40 in the closing cover 19. By specifically screwing an adjusting nut 41 on the thread of the adjusting rod 39 outside the closing cover 19, the first adjusting rod 39 can be adjustably positioned in the adjusting device 12, in the cavity 17 of the hollow cylinder 13 or in the cutout 37 of the control piston 24.

Fixed on the adjusting rod 39 in the region between the second step 42 and the third opening 38 of the cutout 37 of the control piston 24, there is a first spring plate 43 and a second spring plate 44. The first spring plate 43 is fixed on the adjusting rod 39 in that the pretension force of a pressure spring assembly 45 tensioned between the first spring plate 43 and the second spring plate 44 presses the spring plate 43 against the inside end face 46 of a closing flange 47 fixed to the internal hollow cylinder end of the adjusting rod 39. The second spring plate 44 is fixed on the adjusting rod 39 in that the pretension force of the pressure spring assembly 45 presses the spring plate 44 against a sleeve 48 fixed between the spring plate 44 and the closing cover 19 on the adjusting rod 39. The sleeve 48 has, on its inside, an annular groove in which an annular body 55 is fixed, which is arranged in a groove of the first adjusting rod 39 and is supported against the inside end face **46*a* of the groove arranged in the adjusting rod 39. The sleeve 48 and the position of the groove arranged in the adjusting rod could also be constructed according to a further embodiment illustrated in FIG. 3 so that the spring plate 44 is pressed directly against the annular body 55. In the exemplary embodiment, the pressure spring assembly 45 is composed of the two parallel-arranged pressure springs 45A and 45B, so that a compact construction can be achieved with the pressure spring assembly 45**.

In addition to being fixed to the adjusting rod 39, a first spring plate 43 is in contact with the second step 42 of the cutout 37 of the control piston 24 by means of its end face 49 which is remote from the pressure spring assembly 45. By means of its end face 50 which is remote from the pressure spring assembly 45, the second spring plate 44 is in contact with a snap ring 51 arranged in the vicinity of the third opening 38 in an annular groove on the inner side face of the cutout 37 of the control piston 24.

A second adjusting rod 52, which is guided into the interior 17 of the hollow cylinder 13 by way of a bore 53 in the closing cover 19, serves as an adjustable delimitation for the adjustment travel of the control piston 24 along its longitudinal axis 32. The position of the second adjusting rod 52 within the interior 17 of the hollow cylinder 13 can be altered by screwing an adjusting nut 54 in defined manner on the thread of the second adjusting rod 52 outside the closing cover 19.

The pivot balance 19 is adjusted in the direction of a positive adjustment angle al to effect a zero-point adjustment by positioning the first adjusting rod 39 in the direction of the second opening 18 of the hollow cylinder 13 by means of actuating the first adjusting screw 41. The zero-point setting device 32, comprising the first adjusting rod 19, the pressure spring assembly 45, the first spring plate 43, the second spring plate 44 and the sleeve 48, is thus displaced in the direction of the second opening 18 of the hollow cylinder 13. The force required for this displacement is transmitted from the closing flange 47 of the adjusting rod 39, which is moved in the direction of the second opening 18 of the hollow cylinder 13, by way of its inside end face 46 to the first spring plate 43, from the first spring plate 43 to the pressure spring assembly 45, from the pressure spring assembly 45 to the second spring plate 44 and finally from the second spring plate 44 to the snap ring 51 which, fixed with form fit to the control piston 24, displaces the control piston 24 in the direction of the second opening 18.

The pivot balance 19 is adjusted in the direction of a negative adjustment angle $\alpha 2$ to effect a zero-point adjustment by positioning the first adjusting rod 39 in the direction of the first opening 15 of the hollow cylinder 13 by means of actuating the first adjusting screw 41. The zero-point setting device 32 is thus displaced in the direction of the first opening 15 of the hollow cylinder 13. In this case, the force is transmitted from the sleeve 48, which is moved by way of the annular body 55 with the first adjusting rod 39 in the direction of the first opening 15 of the hollow cylinder 13, to the second spring plate 44, from the second spring plate 44 to the pressure spring assembly 45, from the pressure spring assembly 45 to the first spring plate 43 and finally from the first spring plate 43 to the second step 42 of the cutout 37 of the control piston 24. The transmission of the force to the control piston 24 effects a displacement of the control piston 24 in the direction of the first opening 15 of the hollow cylinder 13.

In addition to the damped force transmission from the first adjusting rod 39 to the control piston 24 within the framework of the zero-point adjustment of the pivot balance 9, the predominant task of the pressure spring assembly 45 is that of generating a spring force which is proportional to the excursion of the control piston 24 and which counteracts the control force triggering the movement. This restoring spring force is identical for both displacement directions of the control piston 24 owing to the use of a single pressure spring assembly 45. The spring force of the pressure spring assembly 45 also has a defined value in the zero position of the pivot balance 9 since the pressure spring assembly 45 is held pretensioned between the first spring plate 43 and the second spring plate 44 in each of the positions of the control piston 24.

If the control pressure which is guided through the first control pressure opening 31 into the first control pressure chamber 28 and acts on the first side wall 30, serving as the working surface, of the flange-like widening 26 is greater than the control pressure which is guided through the second control pressure opening 33 into the second control pressure chamber 29 and acts on the second side wall 32, serving as the working surface, of the flange-like widening 26, then the control piston 24 is displaced in the direction of the second opening 18 of the hollow cylinder 13. As a result of the displacement of the control piston 24 in the direction of the second opening 18 of the hollow cylinder 13, the first spring plate 43 is subjected to a force at its end face 49 from the second step 42 of the hollow cylinder 13, which force is transmitted by way of the pressure spring assembly 45 to the second spring plate 44 and results in a displacement of the second spring plate in the direction of the second opening 18 of the hollow cylinder 13. The second spring plate 44 lies with its end face 50 against the sleeve 48 and, due to the adjusting rod 39 being fixed locally and to the sleeve 48, is not displaceable in the direction of the second opening of the hollow cylinder 13. In this case, a further increase in the control pressure in the first control pressure chamber 28 results in an additional compression of the pressure spring assembly 45 and therefore in an additional increase in the spring force, which is proportional to the further increase in the control pressure. This ensures a steady displacement of the control piston 24 in the adjusting device 12, which is proportional to the control pressure difference between the first control pressure chamber 28 and the second control pressure chamber 29.

If the control pressure guided into the first control pressure chamber 28 is lower than the control pressure guided into the second pressure chamber 29, the control piston 24 is displaced in the direction of the first opening 15 of the hollow cylinder 13. By way of the displacement of the control piston 24, and therefore the snap ring 51 integrated in the control piston 24, in the direction of the first opening 15 of the hollow cylinder 13, a force is transmitted to the second spring plate 44, which is in turn transmitted from the second spring plate 44 to the pressure spring assembly 45. Since the first spring plate 43 always lies with its end face 49 against the second step 46 of the cutout 37 of the control piston 24, the compression of the pressure spring 45 assembly when there is a negative control pressure difference between the first control pressure chamber 28 and the second control pressure 29 is proportional to the increase in the control pressure difference. This ensures a steady increase in the spring force, which is proportional to the control pressure difference between the first control pressure chamber 28 and the second pressure chamber 29, and therefore a proportional displacement of the control piston 24 in the adjusting device 12.

According to FIG. 4, the axial movement of the control piston 24 along its longitudinal axis 11 is converted into a pivotal movement of the pivot balance 9 by way of a slide block 56 which is guided in a groove 57 of the adjusting device 12. The slide block 56 has a cutout (not illustrated in FIG. 4), in which a journal (not illustrated in FIG. 4) is rotatably mounted. This journal is mounted on the side face of a connecting arm 58, which is in turn fixed to the pivot balance 9. The one-dimensional axial movement of the control piston 24 in the adjusting device 12 is consequently converted into a rotary pivotal movement of the pivot balance 9 by way of a one-dimensional sliding movement of the slide block 56 in the groove 57 of the adjusting device 12 in combination with a rotary movement of the journal in the cutout of the slide block 56.

The invention claimed is:

1. A reversible axial piston machine having a cylinder drum which rotates about an axis of rotation and in the cylinder cutouts of which pistons, which are supported against an inclined surface, are movable, a control angle ($\alpha 1$, $\alpha 2$) of said inclined surface being adjustable by an adjusting device, the adjusting device having a control piston which adjusts the control angle ($\alpha 1$, $\alpha 2$) in both pivotal directions and extends with a substantial direction component parallel to the direction of the axis of rotation of the cylinder drum, wherein a zero position of the inclined surface, in which the inclined surface is oriented perpendicularly to the axis of rotation of the cylinder drum, can be set without play by a zero-position setting device; the zero-position setting device comprising a first adjusting rod which is positionably guided in a stepped cutout of the control piston, said cutout extending in the direction of the longitudinal axis of the control piston, and positions the control piston in the two directions of its longitudinal axis, wherein the control piston is guided in a hollow cylinder which has a first step on the inside and whereof a first opening, which is oriented in the direction of the inclined surface, is not closed in order to also enable an axial movement of the control piston outside the hollow cylinder, and whereof a second opening, which is oriented away from the pivot balance, is closed by a closing cover.

2. A reversible axial piston machine according to claim 1, wherein the inclined surface is constructed on a rotatably mounted pivot balance.

3. A reversible axial piston machine according to claim 1, wherein the position of the first adjusting rod outside the adjusting device is set by the first adjusting rod being guided out of the hollow cylinder of the adjusting device by way of the closing cover.

4. A reversible axial piston machine according to claim 1, wherein the control piston is positioned in one of the two directions of the longitudinal axis of the control piston by a respective first and second spring plate which is each fixed on the first adjusting rod.

5. A reversible axial piston machine according to claim 4, wherein the first spring plate is fixed on the first adjusting rod in that the first spring plate is pressed against the inside end face of a closing flange by the spring force of at least one pretensioned pressure spring located between the first and second spring plate, said closing flange being mounted on that end of the first adjusting rod which is located inside the hollow cylinder of the adjusting device.

6. A reversible axial piston machine according to claim 5, wherein the second spring plate is fixed on the first adjusting rod in that the second spring plate is pressed against a sleeve by the spring force of the pretensioned pressure spring, said sleeve being guided between the second spring plate and the closing cover on the adjusting rod.

7. A reversible axial piston machine according to claim 4, wherein the control piston is positioned in the direction of the first opening of the hollow cylinder in that the first spring plate is pressed against the end face of a second step of the cutout of the control piston as a result of the first adjusting rod being positioned in the direction of the first opening of the hollow cylinder.

8. A reversible axial piston machine according to claim 4, wherein the control piston is positioned in the direction of the second opening of the hollow cylinder in that the second spring plate is pressed against a snap ring as a result of the first adjusting rod being positioned in the direction of the second opening of the hollow cylinder, said snap ring being guided in an annular groove along the side face of the cutout of the control piston in the region of the third opening of the cutout.

9. A reversible axial piston machine according to claim 1, wherein the closing cover has an annular web whereof the external diameter corresponds to the internal diameter of the hollow cylinder from the second opening to the first step of the hollow cylinder, and whereof the internal diameter corresponds to the internal diameter of the hollow cylinder from the first step to the first opening of the hollow cylinder.

10. A reversible axial piston machine according to claim 9, wherein the closing cover is guided in the second opening of the hollow cylinder by means of its tubular web in such a way that a cavity is produced between the hollow cylinder, the closing cover and the control piston and, at the same time, the control piston is mounted on the inner side wall of the annular web of the closing cover and the inner side wall of the hollow cylinder between the first step and the first opening of the hollow cylinder.

11. A reversible axial piston machine according to claim 10, wherein the control piston has, on its lateral surface in the region of the cavity, a widening which reaches to the inner side wall of the hollow cylinder and divides the cavity into a first control pressure chamber and a second control pressure chamber.

12. A reversible axial piston machine according to claim 11, wherein the first and second control pressure chambers are each supplied with a control pressure by way of a respective control pressure opening in the wall of the hollow cylinder.

13. A reversible axial piston machine according to claim 11, wherein the two side faces of the widening of the control piston serve as working surfaces for the two control pressures for displacing the control piston in the two directions along the longitudinal axis of the control piston.

14. A reversible axial piston machine according to claim 13, wherein with a defined control pressure, the control piston effects an equal control angle ($\alpha 1$, $\alpha 2$) of the inclined surface in both pivotal directions as a result of the working surfaces of the control piston being of equal size.

15. A reversible axial piston machine according to claim 2, wherein the control piston, which is axially movable in the direction of its longitudinal axis, is attached with form fit to the pivot balance by way of a slide block which is mounted in a groove of the control piston and has a cutout in which a journal connected to the pivot balance by way of a connecting arm is fixedly mounted.

16. A reversible axial piston machine according to claim 5, wherein with an equal excursion of the control piston in one of the two directions along the longitudinal axis of the control piston, the pressure spring, which is fixed in the cutout of the control piston on the first adjusting rod, generates an equal restoring force for both directions of the excursion as a result of a defined control pressure.

17. A reversible axial piston machine according to claim 1, wherein the axial excursion of the control piston along the longitudinal axis of the control piston is adjustably delimited by way of a second adjusting rod, which is guided out of the hollow cylinder of the adjusting device by way of the closing cover.

* * * * *